US009017546B2

(12) United States Patent
Mazyar et al.

(10) Patent No.: US 9,017,546 B2
(45) Date of Patent: Apr. 28, 2015

(54) EXFOLIATION OF ASPHALTENES

(75) Inventors: Oleg A. Mazyar, Houston, TX (US); Gaurav Agrawal, Aurora, CO (US)

(73) Assignee: Baker Hughes Incorporated, Houston, TX (US)

( * ) Notice: Subject to any disclaimer, the term of this patent is extended or adjusted under 35 U.S.C. 154(b) by 398 days.

(21) Appl. No.: 13/526,847

(22) Filed: Jun. 19, 2012

(65) Prior Publication Data

US 2013/0334098 A1 Dec. 19, 2013

(51) Int. Cl.
*C10G 1/04* (2006.01)

(52) U.S. Cl.
CPC ..... *C10G 1/047* (2013.01)

(58) Field of Classification Search
CPC ..... C10C 3/02; C10C 3/023
USPC ..... 208/6, 44–45, 309
See application file for complete search history.

(56) References Cited

U.S. PATENT DOCUMENTS

| | | | | |
|---|---|---|---|---|
| 2,970,099 | A | 1/1961 | Illman | |
| 3,975,396 | A | 8/1976 | Bushnell et al. | |
| 4,096,914 | A | 6/1978 | McLaughlin et al. | |
| 4,124,486 | A | 11/1978 | Nolley, Jr. | |
| 4,422,926 | A | 12/1983 | Gould et al. | |
| 4,440,633 | A | 4/1984 | Jacquin et al. | |
| 4,493,765 | A | 1/1985 | Long et al. | |
| 4,752,382 | A | 6/1988 | Eidem | |
| 4,946,892 | A | 8/1990 | Chung | |
| 5,055,179 | A | 10/1991 | Tyrer | |
| 5,110,443 | A * | 5/1992 | Gregoli et al. | 208/46 |
| 5,228,977 | A | 7/1993 | Moran et al. | |
| 6,048,904 | A | 4/2000 | Wiehe et al. | |
| 6,220,352 | B1 | 4/2001 | Walton | |
| 6,274,030 | B1 | 8/2001 | Wallace et al. | |
| 2006/0241237 | A1 | 10/2006 | Drzal et al. | |
| 2007/0092432 | A1 | 4/2007 | Prud'Homme et al. | |
| 2007/0284283 | A1 | 12/2007 | Duyvesteyn | |
| 2008/0020949 | A1 | 1/2008 | Trimble et al. | |
| 2009/0054581 | A1 | 2/2009 | Prud' Homme et al. | |
| 2009/0134059 | A1 | 5/2009 | Myers et al. | |
| 2011/0079748 | A1 | 4/2011 | Ruoff et al. | |

FOREIGN PATENT DOCUMENTS

WO 2008157209 A1 12/2008

OTHER PUBLICATIONS

Charles Allan Brown, "Potassium Hydride, a Highly Active New Hydride Reagent. Reactivity, Applictaions, and Techniques in Organic and Organometallic Reactions 1-3," J. Org. Chem., vol. 39, No. 26, 1974, pp. 3913-3917.

(Continued)

*Primary Examiner* — Brian McCaig
(74) *Attorney, Agent, or Firm* — Cantor Colburn LLP

(57) ABSTRACT

A method for decomposing an asphaltene particle includes contacting the asphaltene particle with an intercalating agent; and reacting the intercalating agent to increase a distance between asphaltene molecules in the asphaltene particle to decompose the asphaltene particle. In a method for producing decomposed asphaltene, the method includes disposing an intercalating agent in an oil environment; contacting an asphaltene particle in the oil environment with the intercalating agent; reacting the intercalating agent to produce product molecules; and decomposing the asphaltene particle to produce decomposed asphaltene.

30 Claims, 2 Drawing Sheets

(56) References Cited

OTHER PUBLICATIONS

Jean Melin et al., "Thermal Stability and Structure of Graphite-Antimony Pentachloride Compounds," Carbon, 1975, vol. 13, pp. 357-362.
New Mexico Tech, [online]; [retrieved on Jul. 19, 2012]; retrieved from the Internet http://baervan.nmt.edu/Petrophysics/group/intro-2-asphaltenes.pdf, "What are asphaltenes?," 13p.
Ronald J. Gillespie et al., "Reactions of S3N3F3 and S3N3Cl3 with Lewis Acids, Preparation and Crystal Structure of Pentathiazyl Hexachloroantimonate, (S5N5) (SbCl6)," Inorg. Chem. 1982, 21, 1296-1302, pp. 1296-1302.
Toshiaki Enoki et al., Graphite Intercalation Compounds and Applications, Synthesis and Intercalation Chemistry, Oxford Unversity Press, 2003, pp. 30-39.
Toshiaki Enoki et al., Graphite Intercalation Compounds and Applications, Synthesis and Intercalation Chemistry, Oxford Unversity Press, pp. 16-19.
Sasha Stankovich et al., "Synthesis and exfoliation of isocyanate-treated graphene oxide nanoplatelets," Carbon 44 (2006), pp. 3342-3347.
K.S. Novoselov et al., "Electric Field Effect in Atomically Thin Carbon Films," Science, 2004, pp. 666-669, vol. 306.
Alexander A. Green et al., "Solution Phase Production of Graphene with Controlled Thickness via Density Differentiation," Nano Lett., 2009, vol. 9, No. 12, pp. 4031-4036.
Athanasios B. Bourlinos et al., "Liquid-Phase Exfoliation of Graphite Towards Solubilized Graphenes," Small 2009, 5, No. 16, pp. 1841-1845.
Graeme Williams et al., "TiO2-Graphene Nanocomposites. UV-Assisted Photocatalytic Reduction of Graphene Oxide," ACS Nano, 2008, vol. 2, No. 7, pp. 1487-1491.
Jay R. Lomeda et al., "Diazonium Functionalization of Surfactant-Wrapped Chemically Converted Graphene Sheets," J. Am. Chem. Soc.; 2008, 130, pp. 16201-16206.
K.S. Novoselov et al., "Two-dimensional atomic crystals," PNAS; Jul. 26, 2005, pp. 10451-10453, vol. 102, No. 30.
Mustafa Lotya et al., "Liquid Phase Production of Graphene by Exfoliation of Graphite in Surfactant/Water Solutions," J. Am. Chem. Soc. 2009, vol. 131, No. 10, pp. 3611-3620.
Peter Blake et al., "Graphene-Based Liquid Crystal Device," Nano Letters, 2008, vol. 8, No. 6, pp. 1704-1708.
Sasha Stankovich et al., "Synthesis of graphene-based nanosheets via chemical reduction of exfoliated graphite oxide," Carbon 45 (2007), pp. 1558-1565.
Umar Khan et al., "High-Concentration Solvent Exfoliation of Graphene," Small, 2010, 6, No. 7, pp. 864-871.
Vincent C. Tung et al., "High-throughput solution processing of large-scale graphene," Nature Nanotechnology, vol. 4, Jan. 2009, www.nature.com/naturenanotechnology, pp. 25-29.
Yenny Hernandez et al., "High-yield production of graphene by liquid-phase exfoliation of graphite," Nature Nanotechnology, vol. 3, Sep. 2008, pp. 563-568.
Zhihong Tang et al., "Exfoliation of Graphene from Graphite and Their Self-Assembly at the Oil-Water Interface," Langmuir, 2010, 26 (11), pp. 9045-9049.
International Preliminary Report on Patentability for related PCT Application No. PCT/US2013/022092, Apr. 29, 2013, pp. 1-7.
International Search Report for related PCT Application No. PCT/US2013/022092, Apr. 29, 2013, pp. 1-3.
International Search Report for related PCT Application No. PCT/US2013/041376, Aug. 13, 2013, pp. 1-3.
Written Opinion for related PCT Application No. PCT/US2013/022092, Apr. 29, 2013, pp. 1-5.
Banerjee et al., "Asphaltenes and Their Role in Bitumen", Oil Sands, Heavy Oil, and Bitumen: From Recovery to Refinery, 2012, pp. 16-22.
Goual et al., "Effect of Resins and DBSA on Asphaltene Precipitation from Petroleum Fluids", AIChE Journal, vol. 50, No. 2, Feb. 2004, pp. 470-479.
Li et al., "A study of the interactions responsible for colloidal structures in petroleum residua", Fuel, vol. 76, No. 14/15, pp. 1459-1463.

* cited by examiner

EXFOLIATION OF ASPHALTENES

BACKGROUND

Asphaltenes are a major component in crude oil, and there is general agreement as to the deleterious effects of asphaltenes in the reduction of oil extraction and processing in the petrochemical industry. Asphaltenes can deposit in the pores of formations, blocking the flow of fluids. Additionally, asphaltenes can precipitate from a stream of oil and coat boreholes, production tubing, and transport lines. Moreover, in a processing facility, asphaltenes can foul processing equipment and poison catalysts.

Asphaltene molecules have been widely reported as having a fused polyaromatic ring system and containing heteroatoms such as sulfur, oxygen, nitrogen, and the like. The heteroatoms may be part of the aromatic ring system or part of other carbocyclic rings, linking groups, or functional groups. Two structural motifs for asphaltene molecules are the so-called continental and archipelago structures. In the continental structure, alkyl chains connect to and branch from a central polyaromatic ring system, which is believed to contain several fused aromatic rings, e.g., 5 or more aromatic rings. In the archipelago structure, multiple polyaromatic ring systems are connected by alkyl chains that may contain a heteroatom, and additional alkyl chains extend freely from the polyaromatic rings. The number of fused aromatic rings in the continental structure can be greater than the number of fused aromatic rings in the archipelago structure.

In addition to the aromatic regions of the asphaltenes, heteroatoms provide the asphaltenes with polar regions, and the terminal alkyl chains provide hydrophobic regions. Consequently, it is believed that asphaltene molecules aggregate into various micellular structures in oil, with the alkyl chains interacting with the aliphatic oil components. Resin from the oil can insert between aromatic planes of neighboring asphaltene molecules in asphaltene aggregates, aiding in maintaining their micellular structure. Asphaltenes can precipitate from oil in structures where asphaltene molecules form stacked layers having aligned aromatic regions and aligned aliphatic regions.

Materials and methods for treating and removal of asphaltenes from oil environments would be well received in the art.

BRIEF DESCRIPTION

Disclosed in an embodiment is a method for decomposing an asphaltene particle, the method comprising: contacting the asphaltene particle with an intercalating agent; and reacting the intercalating agent to increase a distance between asphaltene molecules in the asphaltene particle to decompose the asphaltene particle.

In another embodiment, a method for producing decomposed asphaltene comprises disposing an intercalating agent in an oil environment; contacting an asphaltene particle in the oil environment with the intercalating agent; reacting the intercalating agent to produce product molecules; and decomposing the asphaltene particle to produce decomposed asphaltene.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
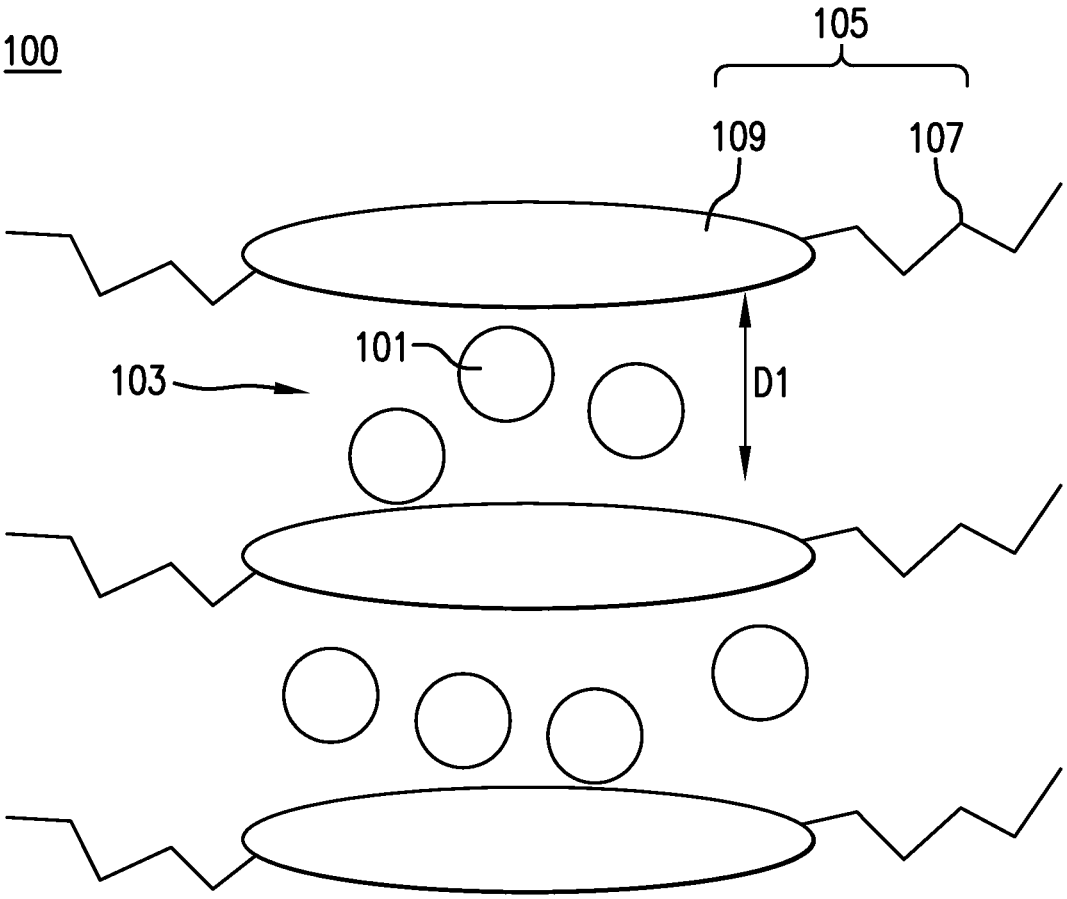
FIG. 1 shows an asphaltene particle with an intercalating agent disposed in a gallery of asphaltene molecules.

A detailed description of one or more embodiments of the disclosed material and method are presented herein by way of exemplification and not limitation with reference to the Figures.

An asphaltene particle includes any collection of asphaltene molecules, for example, a micelle, precipitate, layered asphaltene molecules, aggregate, cluster, and the like. Interactions among the asphaltene molecules in an asphaltene particle may include hydrogen bonding, dipole-dipole interactions, and $\pi$-$\pi$ interactions. Without wishing to be bound by theory, disruption of these interactions can lead to exfoliation of an asphaltene molecule from the asphaltene particle. Since asphaltenes form layered aggregates that resemble the layered structure of graphite, perturbing the layered asphaltene structure allows for asphaltene production from decomposed asphaltene aggregates. Such decomposition is useful for extraction of oil from an oil environment, e.g., a formation, as well as for restoration of the permeability of a plugged or flow-constricted reservoir. The methods herein are applicable to a downhole as well as to a ground environment.

It has been found that perturbing the internal structure of asphaltene particles, for example, in a micelle or other aggregate, can lead to increased quality of oil containing asphaltenes. Further, degradation of asphaltene aggregates herein enhances production of petroleum fluid in a downhole, subsurface, or ground environment. Furthermore, removal of asphaltene from pores of a rock formation, within a reservoir, or from a sidewall of a tubular, production tubing, borehole, or transportation tube can improve the permeability of such structures, leading to increased quality of oil as well as increased or prolonged lifetime for oil production.

In an embodiment, a method for decomposing an asphaltene particle includes contacting the asphaltene particle with an intercalating agent and reacting the intercalating agent to increase a distance between asphaltene molecules in the asphaltene particle to decompose the asphaltene particle. The intercalating agent can be disposed in the gallery between adjacent asphaltene molecules or disposed at the periphery of an asphaltene molecule such as proximate to an edge of an aromatic plane or terminal chain attached to an aromatic portion of an asphaltene molecule in the asphaltene particle.

In a non-limiting embodiment, decomposing the asphaltene particle further includes expanding the volume of the asphaltene particle. Volumetric expansion can decrease the interaction energy among the asphaltene molecules in the asphaltene particle, which can make it easier to remove an asphaltene molecule from the asphaltene particle. Volume expansion can occur, for example, by introduction of an intercalating agent between adjacent asphaltene molecules. In one embodiment, the intercalating agent can be reacted to produce product particles (e.g., atoms or molecules) that increase the volume between the asphaltene molecules. In an embodiment, the number of the product particles per molecule of intercalating agent is greater than one, i.e., a molecule of intercalating agent produces more than one product particle. In another embodiment, the volume of a product particle (i.e., a particular product molecule) is greater than that of the intercalating agent. In some embodiments, a molecule of intercalating agent produces more than one product particle that has a volume greater than that of the intercalating agent. In either case, a gallery between asphaltene molecules in the asphaltene particle increases in response to reaction of the intercalating agent to produce product particles.

In an embodiment, the reaction of the intercalating agent can be a unimolecular decomposition reaction. According to another embodiment, the reaction is disproportionation of the intercalating agent. In yet another embodiment, the reaction is hydrolysis of the intercalating agent. In a further embodiment, the product particles undergo a reaction to produce other product particles, which causes volume expansion of the asphaltene particle. Due to the volume expansion of the gallery between asphaltene molecules in the asphaltene particle, a distance between asphaltene molecules increases by reacting the intercalating agent, which decomposes the asphaltene particle. In some embodiments, the intercalating agent in the gallery can react with an asphaltene molecule to produce a product (e.g., molecule or atom) that expands the inter-molecular separation among asphaltene molecules of the asphaltene particle. Without wishing to be bound by theory, the disproportionation of an intercalating agent is contemplated to occur via asphaltene-mediated reactions, such as electron transfer between $\pi$ or $\pi^*$ orbitals of the aromatic portion of the asphaltene and the intercalating agent (or between $\pi$ or $\pi^*$ orbitals or lone pairs of heteroatoms in an asphaltene molecule and the intercalating agent). During the volume expansion, the molecules in the gallery force the adjacent asphaltene molecules away from one another, thereby separating the asphaltene molecules. In this manner, an asphaltene molecule can be exfoliated from the asphaltene particle.

As used herein, "product" refers to a molecule or atom that is produced in a reaction involving the intercalating agent. The molecule or atom can be neutral or charged, e.g., a cation or anion. The product can include a combination of a molecule or atom as well as a combination of charged or neutral species thereof. As used herein, "decomposition" refers to an increased separation distance between asphaltene molecules in an asphaltene particle, expansion of the volume of the asphaltene particle, complete removal of an asphaltene molecule from an asphaltene particle, or a change in the electronic structure or bonding in an asphaltene molecule in an asphaltene particle. An example of a change in the electronic structure or bonding in an asphaltene molecule in an asphaltene particle includes converting bond (e.g., converting a $\pi$ bond to $\sigma$ bond or vice versa), breaking a bond, or forming a bond.

Thus, according to an embodiment, the method includes exfoliating an asphaltene particle. In an embodiment, exfoliating includes removing an asphaltene molecule from the asphaltene particle. Exfoliation of an asphaltene particle, in an embodiment, decreases the number of asphaltene molecules in the asphaltene particle. It will be appreciated that exfoliation of asphaltene particles may provide exfoliated asphaltene as a single asphaltene molecule or as a micelle or layered particle containing fewer asphaltene molecules than the non-exfoliated asphaltene particle.

According to an embodiment, reacting the intercalating agent produces a plurality of product molecules, atoms, or combination thereof per molecule of the intercalating agent. In an embodiment, the number of product molecules, atoms, or the combination thereof per molecule of the intercalating agent is 1.1 to 100, specifically 1.1 to 50, and more specifically 1.1 to 10. In a particular embodiment, the intercalating agent is reacted in a hydrolysis reaction. Here, water contacts the intercalating agent. The water for hydrolysis can be introduced via a number of ways. In an embodiment, the water is introduced chemically, mechanically, or a combination thereof In a particular embodiment, introducing the water includes releasing water in situ from a hydrating agent. In another embodiment, the water is introduced mechanically such as in hot water injection, steam stimulation, or a combination comprising at least one of the foregoing.

In a further embodiment, the method includes increasing the temperature of the intercalating agent in the asphaltene particle. Increasing the temperature includes techniques that can elevate the temperature to about 60° C. to about 1200° C., specifically about 100° C. to about 1000° C., and more specifically about 100° C. to about 800° C. Such techniques involve, for example, in-situ combustion, steam introduction, heated fluid injection, or a combination comprising at least one of the foregoing. In an embodiment, a downhole environment is heated by introducing steam in an injection well with the steam propagating through the formation and heating the intercalating agent. Thus, the intercalating agent can thermally decompose or react as provided above. It is contemplated that increasing the temperature will affect the kinetics, reaction pathways, and branching ratios of the reactions of the intercalating agent. In addition to the reaction of the intercalating agent, the asphaltene particles can also be heated and expand, decreasing the mutual attraction among asphaltene molecules therein. Depending on the amount of expansion of the asphaltene particle, asphaltene molecules can exfoliate from the asphaltene particles. In one embodiment, the heating of an intercalating agent associated with the asphaltene particle can lead to exfoliation of an asphaltene molecule therefrom.

Heated fluid injection can include heating a fluid (e.g., a solvent) and subsequently disposing the heated fluid downhole to increase the temperature of the asphaltene particles. In a non-limiting embodiment, in-situ combustion increases the temperature of the intercalating agent by injecting a gas containing oxygen, for example air, downhole and igniting oil in the reservoir. The combustion releases heat, which can be absorbed by the intercalating agent or asphaltene particle, in order to exfoliate an asphaltene molecule from the asphaltene particle.

In certain embodiments, the method further includes applying sonic frequencies to the intercalating agent. The sonic frequencies can be from about 400 hertz (Hz) to about 400 megahertz (MHz), specifically about 800 Hz to about 350 MHz, and more specifically about 1 kilohertz (kHz) to about 300 MHz. A transducer placed near the asphaltene particle can produce the sonic frequency, which can destructively interact with the asphaltene particle or intercalating agent. Sonic frequencies may induce chemical reactions of the intercalating agent and disrupt interparticle bonding in the asphaltene particle, leading to exfoliation of an asphaltene molecule. The sonic frequencies can detach neighboring polyaromatic planes of adjacent asphaltene molecules. Without wishing to be bound by any particular theory, such deterioration of the asphaltene particle may be induced by short-lived, localized disturbances (e.g., a hot spot) produced by the implosion of bubbles in the course of acoustic cavitation.

Figure 2:
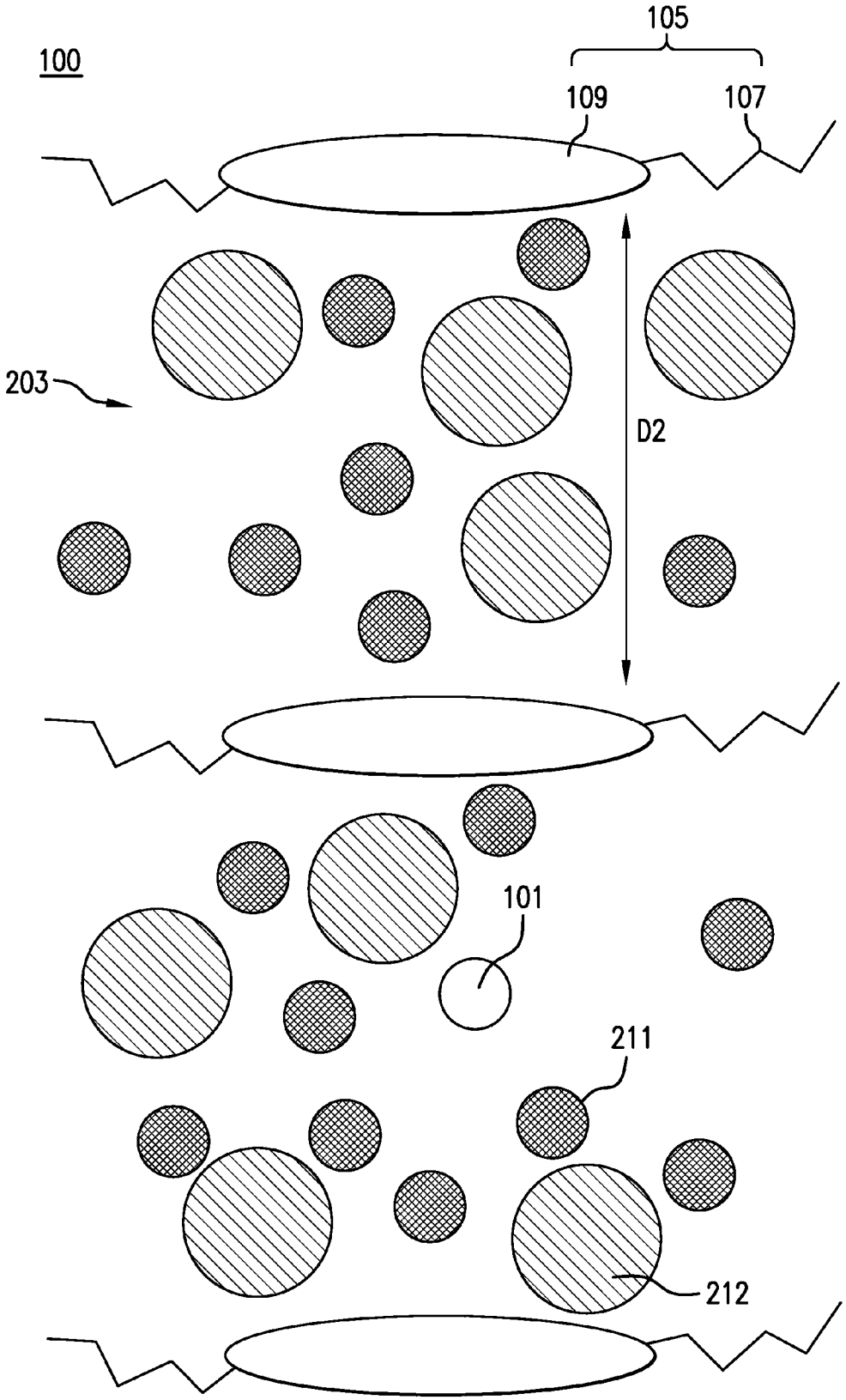
FIG. 2 shows an asphaltene particle with reaction products from an intercalating agent disposed in a gallery of asphaltene molecules.

As shown in FIG. 1, in an embodiment, an intercalating agent 101 is disposed in a gallery 103 of adjacent asphaltene molecules 105 of an asphaltene particle 100. The asphaltene molecule 105 has an aliphatic tail 107 extending from a polyaromatic fused ring system 109. A distance D1 is the spacing between adjacent asphaltene molecules 105. As shown in FIG. 2, the intercalating agent 101 reacts to produce product particles (atoms or molecules) 211, 212. Certain product particles 212 have a greater size than the intercalating agent 101. In some embodiments, more product particles 211, 212 are produced from the reaction of the intercalating agent 101 than the initial number of molecules of the intercalating agent 101. Also, the volume of the gallery 203 increases to a distance D2 between adjacent asphaltene molecules from smaller distance D1. Since the resulting distance D2 is greater than the initial distance D1, the interaction energy among the asphaltene molecules 105 decreases, leading to exfoliation of an asphaltene molecule from the asphaltene particle 100. In an embodiment, the reaction of the intercalating agent can be facile so that the distance between adjacent asphaltene molecules increases abruptly to have an enhanced exfoliation rate. This can occur when, for example, gas is rapidly produced from the intercalating agent or from production of a large number of product particles.

An exemplary intercalating agent is a metal halide, alkali metal hydride, or any species that, e.g., can undergo hydrolysis or disproportionation in a gallery of asphaltene molecules to cause exfoliation. In an embodiment, the metal halide includes a metal such as Mg, Zn, Cd, Hg, Mn, Fe, Co, Ni, Pd, Cu, B, Al, In, Ga, Tl, Cr, Fe, Ru, Os, Au, Y, Sm, Eu, Gd, Tb, Dy, Ho, Er, Tm, Yb, Lu, Zr, Hf, Re, Pt, Sb, Nb, Ta, Mo, U, W, Li, Si, Ti, P, As, Mo, or a combination comprising at least one of the foregoing. Exemplary alkali metals of the alkali metal hydride include Group I elements of the periodic table. The halogen of the metal halide includes chlorine, fluorine, bromine, iodine, or a combination comprising at least one of the foregoing. Exemplary metal halides thus include $SbCl_5$, $FeCl_3$, $FeCl_2$, $MgCl_2$, $ZnCl_2$, $CdCl_2$, $CoCl_2$, $AuCl_3$, $TiCl_4$, $ZrCl_4$, $NbCl_5$, $TaCl_5$, $CrCl_3$, $MoCl_5$, $WCl_6$, $MnCl_2$, ReCl, $RuCl_3$, $OsCl_3$, $GdCl_3$, $RhCl_3$, $IrCl_4$, $TbCl_3$, $PdCl_2$, $PtCl_4$, $BCl_3$, $GaCl_3$, $InCl_3$, $TiCl_3$, $SbCl_4$, $(Co,Mn)Cl_2$, $(Co,Ni)Cl_2$, $MnFeCl_5$, $SbF_5$, $AlCl_3$, $NiCl_2$, $AsF_5$, $CuCl_2$, $MoF_6$, $OsF_6$, $IrF_6$, $PtF_6$, $UF_6$, $WF_6$, $SbF_5$, $RuF_5$, $OsF_5$, $BF_3$, $RhF_3$, $AuF_3$, $TiF_4$, $SiF_4$, $GeF_4$, $NbF_5$, $TaF_5$, $PF_S$, or a combination comprising at least one of the foregoing. Consequently, the metal halide also includes bi, tri, and higher order metal halide compounds such as $SbCl_5$-$ZnCl_2$, $FeCl_3$-$AsF_5$, and the like. The alkali metal hydride can be, e.g., LiH, NaH, KH, RbH, CsH, and the like. The alkali metal hydride can be used in combination with other reactive intercalating agents such as the metal halides.

In some embodiments, the intercalating agent is dispersed in a solvent. Such dispersion can occur before or after contacting the asphaltene particle with the intercalating agent. The solvent can be an organic solvent, inorganic solvent, or a combination comprising at least one of the foregoing. Exemplary solvents include $CH_3NO_2$, $CH_2Cl_2$, $CHCl_3$, $CCl_4$, $C_2H_4Cl_2$, $H_2O$, $SOCl_2$, $SO_2Cl_2$, $S_3N_3Cl_3$, benzene, toluene, o-xylene, dimethyl sulfoxide, furan, tetrahydrofuran, o-dioxane, m-dioxane, p-dioxane, dimethoxyethane, n-methyl-pyrrolidone, n,n-dimethylacetamide, γ-butyrolactone, 1,3-dimethyl-2-imidazolidinone, benzyl benzoate, hexafluorobenzene, octafluorotoluene, pentafluorobenzonitrile, pentafluoropyridine, pyridine, dimethylformamide, hexamethylphosphoramide, nitromethane, benzonitrile, or the like. In an embodiment, the solvent can react with the intercalating agent to produce product compounds that have larger molecular volumes than the solvent or intercalating agent.

In an embodiment, the intercalating agent is $SbCl_5$. In a hydrolysis reaction of the $SbCl_5$ intercalating agent within the gallery of adjacent asphaltene molecules, reaction products can be produced from the intercalating agent that include, for example, $Sb_2O_5$, $SbO_2Cl$, $SbO_4H_3$, HCl, and the like. In a disproportionation reaction of the $SbCl_5$ intercalating agent, reaction products can be produced from the intercalating agent that include, for example, $SbCl_6^-$, $SbCl_3$, and the like. Thus, the reaction produces a greater number of reaction products than the number of reagents, causing expansion of the gallery in the asphaltene particle. Certain members of the reaction products (e.g., $SbCl_6^-$) have a greater molecular volume than that of the intercalating agent and therefore occupy a larger gallery size so that the product causes a greater separation between asphaltene molecules. In another embodiment, the intercalating agent can be subjected to thermal treatment including heating the intercalating agent in the gallery or to sonic (e.g., acoustic or ultrasound) frequencies to increase reactivity of the intercalating agent or the expansion rate of the gallery. Consequently, upon reaction, the intercalating agent can provide multiple reaction products that push the asphaltene molecules away from one another in order to exfoliate an asphaltene molecule or decrease the interaction energy among constituents of the asphaltene particle.

In an embodiment, reacting includes a reaction between the intercalating agent and a solvent. In a particular embodiment, a reaction occurs between $S_3N_3Cl_3$ (trichlorocyclotrithiazene) and $SbCl_5$. Here, $SbCl_5$ in $CH_2Cl_2$ can be introduced to asphaltene aggregates as an intercalation compound followed by introduction of $S_3N_3Cl_3$ in $CH_2Cl_2$. For a 1:1 mole ratio of $S_3N_3Cl_3$ to $SbCl_5$, product compounds such as $(S_5N_5)(SbCl_6)$ and $S_4N_4$*$SbCl_5$ can be formed. It is believed that $(S_5N_5)(SbCl_6)$ and $S_4N_4$*$SbCl_5$ have larger volumes than the original $SbCl_5$ molecule, and, thus, the distance between the asphaltene molecules in the asphaltene aggregate increases. In another embodiment, the mole ratio of $S_3N_3Cl_3$ to $SbCl_5$ is 1:2 such that $(S_4N_4)(SbCl_6)_2$ is formed in the reaction. It is also believed that $(S_4N_4)(SbCl_6)_2$has a larger volume than two molecules of $SbCl_6$.

In another embodiment, after reacting the intercalating agent, the asphaltene particle can be heated. The heat is absorbed by the asphaltene molecule, causing high amplitude vibrational motion of the non-polar groups, e.g., hydrocarbon tails that terminate an asphaltene molecule. In this manner, exfoliation of asphaltene molecules can occur by vibrationally-mediated dissociation or further increased spacing among the asphaltene molecules in the asphaltene particle. Additionally, the heated asphaltene particles can be more miscible with solvents. Solvents include, for example, an alkane, aromatic solvent, carbon dioxide, carbon disulfide, resin, oil, or a combination comprising at least one of the foregoing. Particular solvents include, 2,2-dimethylpropane, butane, 2,2-dimethylbutane, pentane, hexane, heptane, octane, nonane, decane, unedecane, cyclopentane, cyclohexane, benzene, toluene, o-xylene, dimethyl sulfoxide, furan, tetrahydrofuran, o-dioxane, m-dioxane, p-dioxane, dimethoxyethane, n-methyl-pyrrolidone, n,n-dimethylacetamide, γ-butyrolactone, 1,3-dimethyl-2-imidazolidinone, benzyl benzoate, hexafluorobenzene, octafluorotoluene, pentafluorobenzonitrile, pentafluoropyridine, pyridine, dimethylformamide, hexamethylphosphoramide, nitromethane, benzonitrile, and the like.

In another embodiment, a solvent or surfactant can contact the exfoliated asphaltene particle and allow dispersion of the asphaltene particle, for example, in an oil. Exemplary solvents include a polar solvent, aromatic solvent, or a combination comprising at least one of the foregoing. The polar solvent can be an alcohol (e.g., ethanol, propanol, glycol, and the like), amine (e.g., methylamine, diethyl amine, tributyl amine, and the like), amide (e.g., dimethylformamide), ether (e.g., diethyl ether, polyether, tetrahydrofuran, and the like), ester (e.g., ethyl acetate, methyl butyrate, and the like), ketone (e.g., acetone), acetonitrile, dimethylsulfoxide, propylene carbonate, and the like. The aromatic solvent can be, for example, benzene, toluene, xylene, pyridine, hexafluorobenzene, octafluorotoluene, pentafluoropyridine, and the like.

The methods herein can be used to enhance oil recovery in a reservoir, borehole, downhole, production zone, formation, or a combination comprising at least one of the foregoing. Additionally, the methods can be used to increase flow velocity of oil in a processing facility, refinery, pre-refinery facility, tubular, reactor, or a combination comprising at least one of the foregoing Reaction of the intercalating agent in a gallery of asphaltene molecules in an asphaltene particle herein can be used to extract asphaltene deposits that constrict flow in, for example, a tubular, and can restore flow in a plugged reservoir. Additionally, exfoliation of asphaltenes can increase permeability in porous media (e.g., a sand screen that can be deformable such as a polymeric open-cell foam) and flow channels (e.g., a crack in a formation filled with proppant such as obtained in a fracking process). As a result of exfoliation to decrease the number of asphaltene molecules in an asphaltene particle, oil viscosity also decreases. Lowering the viscosity of the oil improves production efficiency. Additionally, the detrimental effects of asphaltene can be diminished or eliminated, including alleviation of flocculates of asphaltenes that can plug a reservoir or production tubing, restrict flow in a transport line, stabilize water-in-oil emulsions, foul a production facility, alter wettability of porous rock in the reservoir, or poison a refinery catalyst.

Thus, in an embodiment, a method for producing decomposed asphaltene includes disposing an intercalating agent in an oil environment and contacting an asphaltene particle in the oil environment with the intercalating agent. Reacting the intercalating agent produces product molecules. The embodiment also includes decomposing the asphaltene particle to produce decomposed asphaltene. In a certain embodiment, the method also includes breaking a water-in-oil emulsion in response to decomposing the asphaltene particle. Here the oil-in-water emulsion can be a Pickering emulsion that is stabilized by asphaltene particles at the water-oil interface. Upon decomposing the asphaltene particles, the emulsion is destabilized and thus broken.

In addition, water can be introduced by methods such as hot water injection, steam stimulation, or a combination comprising at least one of the foregoing. It is believed that, in this way, the asphaltene particles decompose as exfoliation of asphaltene molecules in the asphaltene particles occurs. As a result, the viscosity of oil in the oil environment is reduced. Therefore, the method can be used to enhance oil recovery. In a further embodiment, the method includes increasing a permeability of a reservoir of the oil environment. According to another embodiment, the method further includes producing the oil including the decomposed asphaltene from the oil environment, wherein decomposing the asphaltene particle occurs prior to producing the oil. Alternatively or in addition, decomposing the asphaltene particle can occur subsequent to producing the oil.

The methods herein are further illustrated by the following non-limiting examples.

EXAMPLE 1

Pentadecane is added drop wise to a vessel at room temperature that contains crude oil. Addition of the pentadecane continues until small asphaltene aggregates associated with emulsified water droplets become visible under 100× magnification. While stirring the contents of the vessel, the temperature is increased to 170° C. After two hours, an intercalating agent $SbCl_5$ in $SOCl_2$ solvent is added drop wise to the vessel. The temperature of the vessel is maintained at 170° C. for an additional 16 hours. The reacting mixture then is sparged with steam for 8 hours. After sparging, the contents of the vessel are stirred and kept at 170° C. for another 16 hours. The composition is subsequently cooled to 25° C. Asphaltene aggregates and emulsified water were not detected in the treated oil under 100× magnification. In addition, the post-reaction sample from the vessel has lower viscosity at room temperature than the untreated crude oil with added pentadecane.

EXAMPLE 2

Pentadecane is added drop wise to a vessel at room temperature containing crude oil until small asphaltene aggregates become visible under 100× magnification. The vessel with the mixture is placed in a nitrogen-atmosphere glove box and heated to 120° C. After 4 hours, the temperature of the vessel is increased to 250° C. and potassium hydride is added. The content of the vessel is stirred and kept at 250° C. for 16 hours. The reacting mixture is then sparged with steam for 6 hours. After sparging, the temperature is reduced to 120° C. The content of the vessel is stirred and kept at 120° C. for an additional 18 hours. The composition is subsequently cooled to 25° C. Asphaltene aggregates were not detected in the treated oil under 100× magnification. In addition, the post-reaction sample from the vessel has lower viscosity at the room temperature than the untreated crude oil with added pentadecane.

While one or more embodiments have been shown and described, modifications and substitutions may be made thereto without departing from the spirit and scope of the invention. Accordingly, it is to be understood that the present invention has been described by way of illustrations and not limitation. Embodiments herein are can be used independently or can be combined.

All ranges disclosed herein are inclusive of the endpoints, and the endpoints are independently combinable with each other. The suffix "(s)" as used herein is intended to include both the singular and the plural of the term that it modifies, thereby including at least one of that term (e.g., the colorant(s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like. All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. As used herein, the term "a" includes at least one of an element that "a" precedes, for example, "a device" includes "at least one device." "Or" means "and/or." Further, it should further be noted that the terms "first," "second," and the like herein do not denote any order, quantity (such that more than one, two, or more than two of an element can be present), or importance, but rather are used to distinguish one element from another. The modifier "about" used in connection with a quantity is inclusive of the stated value and has the meaning dictated by the context (e.g., it includes the degree of error associated with measurement of the particular quantity).

What is claimed is:

1. A method for decomposing an asphaltene particle, the method comprising:

contacting the asphaltene particle with an intercalating agent; and reacting the intercalating agent to increase a distance between asphaltene molecules in the asphaltene particle to decompose the asphaltene particle, wherein the intercalating agent is one or more of the following: a metal halide or alkali metal hydride; the metal halide comprises one or more of the following: $SbCl_5$; $FeCl_2$; $MgCl_2$; $CoCl_2$; $AuCl_3$; $TiCl_4$; $ZrCl_4$; $NbCl_5$; $TaCl_5$; $CrCl_3$; $MoCl_5$; $WCl_6$; $MnCl_2$; ReCl; $RuCl_3$; $OsCl_3$; $GdCl_3$; $RhCl_3$; $IrCl_4$; $TbCl_3$; $PdCl_2$; $PtCl_4$; $BCl_3$; $GaCl_3$; $InCl_3$; $TiCl_3$; $SbCl_3$; $(Co;Mn)Cl_2$; $(Co;Ni)Cl_2$; $MnFeCl_5$; $SbF_5$; $AlCl_3$; $NiCl_2$; $AsF_5$; $MoF_6$; $OsF_6$; $IrF_6$; $PtF_6$; $UF_6$; $WF_6$; $RuF_5$; $OsF_5$; $BF_3$; $RhF_3$; $AuF_3$; $TiF_4$; $SiF_4$; $GeF_4$; $NbF_5$; $TaF_5$; $PF_5$; and wherein the reacting comprises one or more of the following: decomposing the intercalating agent through a unimolecular decomposition reaction; hydrolyzing the intercalating agent; or disproportionating the intercalating agent.

2. The method of claim 1, further comprising exfoliating the asphaltene particle.

3. The method of claim 2, wherein exfoliating the asphaltene particle comprises removing an asphaltene molecule from the asphaltene particle.

4. The method of claim 1, wherein reacting the intercalating agent comprises producing a plurality of product molecules, atoms, or a combination thereof per molecule of the intercalating agent.

5. The method of claim 4, wherein the number of product molecules, atoms, or the combination thereof per molecule of the intercalating agent is 1.1 to 100.

6. The method of claim 4, further comprising reacting the product molecules to produce other product molecules.

7. The method of claim 1, wherein the intercalating agent is disposed in a gallery of the asphaltene particle.

8. The method of claim 1, further comprising expanding the volume of the asphaltene particle.

9. The method of claim 1, further comprising increasing the temperature of the asphaltene particle.

10. The method of claim 9, wherein the temperature is increased to about 60° C. to about 1200° C.

11. The method of claim 9, wherein increasing the temperature comprises in-situ combustion, steam introduction, heated fluid injection, or a combination comprising at least one of the foregoing.

12. The method of claim 1, further comprising applying sonic frequencies to the intercalating agent.

13. The method of claim 1, wherein the intercalating agent is dispersed in a solvent prior to contacting the asphaltene particle.

14. The method of claim 13, wherein the solvent is an organic solvent, inorganic solvent, or a combination comprising at least one of the foregoing.

15. The method of claim 14, wherein the solvent is $CH_3NO_2$, $CHCl_3$, $CCl_4$, $C_2H_4Cl_2$, $H_2O$, $SOCl_2$, $S_3N_3Cl_3$, or a combination comprising at least one of the foregoing.

16. The method of claim 1, wherein the asphaltene particle is heated after reacting the intercalating agent.

17. A method for decomposing an asphaltene particle, the method comprising:

contacting the asphaltene particle with an intercalating agent; and reacting the intercalating agent to increase a distance between asphaltene molecules in the asphaltene particle to decompose the asphaltene particle;

wherein reacting comprises hydrolyzing the intercalating agent.

18. The method of claim 17, wherein hydrolyzing the intercalating agent comprises introducing water to the intercalating agent.

19. The method of claim 18, wherein introducing water comprises releasing water, in situ, from a hydrating agent.

20. The method of claim 19, wherein the hydrating agent is a salt hydrate.

21. The method of claim 20, wherein the salt hydrate comprises $K_2HPO_4.6H_2O$, $FeBr_3.6H_2O$, $Mn(NO_3)_2.6H_2O$, $FeBr_3.6H_2O$, $CaCl_2.12H_2O$, $LiNO_3.2H_2O$, $LiNO_3.3H_2O$, $Na_2CO_3.10H_2O$, $Na_2SO_4.10H_2O$, $KFe(SO_4)_2.12H_2O$, $CaBr_2.6H_2O$, $LiBr_2.2H_2O$, $Zn(NO_3)_2.6H_2O$, $FeCl_3.6H_2O$, $Mn(NO_3)_2.4H_2O$, $Na_2HPO_4.12H_2O$, $CoSO_4.7H_2O$, $KF.2H_2O$, $MgI_2.8H_2O$, $CaI_2.6H_2O$, $K_2HPO_4.7H_2O$, $Zn(NO_3)_2.4H_2O$, $Mg(NO_3)4H_2O$, $Ca(NO_3).4H_2O$, $Fe(NO_3)_3.9H_2O$, $Na_2SiO_3.4H_2O$, $K_2HPO_4.3H_2O$, $Na_2S_2O_3.5H_2O$, $MgSO_4.7H_2O$, $Ca(NO_3)_2.3H_2O$, $Zn(NO_3)_2.2H_2O$, $FeCl_3.2H_2O$, $Ni(NO_3)_2.6H_2O$, $MnCl_2.4H_2O$, $MgCl_2.4H_2O$, $CH_3COON_a.3H_2O$, $Fe(NO_3)_2.6H_2O$, $NaAl(SO_4)_2.10H_2O$, $NaOH.H_2O$, $Na_3PO_4.12H_2O$, $LiCH_3COO.2H_2O$, $Al(NO_3)_2.9H_2O$, $Ba(OH)_2.8H_2O$, $Mg(NO_3)_2.6H_2O$, $KAl(SO_4)_2.12H_2O$, $MgCl_2.6H_2O$, or a combination comprising at least one of the foregoing.

22. The method of claim 18, wherein introducing water comprises hot water injection, steam stimulation, or a combination comprising at least one of the foregoing.

23. A method for decomposing an asphaltene particle, the method comprising:

contacting the asphaltene particle with an intercalating agent; and reacting the intercalating agent to increase a distance between asphaltene molecules in the asphaltene particle to decompose the asphaltene particle;

wherein reacting comprises disproportionating the intercalating agent.

24. A method for producing decomposed asphaltene, the method comprising:

disposing an intercalating agent in an oil environment;

contacting an asphaltene particle in the oil environment with the intercalating agent;

reacting the intercalating agent to produce product molecules; and decomposing the asphaltene particle to produce decomposed asphaltene, wherein the intercalating agent is one or more of the following: a metal halide or alkali metal hydride; the metal halide comprises one or more of the following: $SbCl_5$; $FeCl_2$; $MgCl_2$; $CoCl_2$; $AuCl_3$; $TiCl_4$; $ZrCl_4$; $NbCl_5$; $TaCl_5$; $CrCl_3$; $MoCl_5$; $WCl_6$; $MnCl_2$; ReCl; $RuCl_3$; $OsCl_3$; $GdCl_3$; $RhCl_3$; $IrCl_4$; $TbCl_3$; $PdCl_2$; $PtCl_4$; $BCl_3$; $GaCl_3$; $InCl_3$; $TiCl_3$; $SbCl_3$; $(Co;Mn)Cl_2$; $(Co;Ni)Cl_2$; $MnFeCl_5$; $SbF_5$; $AlCl_3$; $NiCl_2$; $AsF_5$; $MoF_6$; $OsF_6$; $IrF_6$; $PtF_6$; $UF_6$; $WF_6$; $RuF_5$; $OsF_5$; $BF_3$; $RhF_3$; $AuF_3$; $TiF_4$; $SiF_4$; $GeF_4$; $NbF_5$; $TaF_5$; $PF_5$; and wherein the reacting comprises one or more of the following: decomposing the intercalating agent through a unimolecular decomposition reaction; hydrolyzing the intercalating agent; or disproportionating the intercalating agent.

25. The method of claim 24, further comprising enhancing oil recovery from the oil environment.

26. The method of claim 25, further comprising introducing water which includes hot water injection, steam stimulation, or a combination comprising at least one of the foregoing to the intercalating agent, the asphaltene particle, the oil environment, or a combination comprising at least one of the foregoing.

27. The method of claim 25, further comprising reducing the viscosity of oil in the oil environment.

28. The method of claim 25, further comprising increasing a permeability of a reservoir of the oil environment.

29. The method of claim 25, further comprising breaking a water-in-oil emulsion or an oil-in-water emulsion in response to decomposing the asphaltene particle.

30. The method of claim 24, further comprising removing decomposed asphaltene from a sidewall of a tubular, production tubing, borehole, or transportation tube.

* * * * *